US005388757A

United States Patent [19]

Lorenzen

[11] Patent Number: 5,388,757

[45] Date of Patent: Feb. 14, 1995

[54] RECLOSABLE SALES PACKING, E.G. FOR MEAT SLICES

[75] Inventor: Ove Lorenzen, Hasselager, Denmark

[73] Assignee: Schur International A/S, Horsens, Denmark

[21] Appl. No.: 170,239

[22] PCT Filed: Jun. 25, 1992

[86] PCT No.: PCT/DK92/00198

§ 371 Date: Jan. 11, 1994

§ 102(e) Date: Jan. 11, 1994

[87] PCT Pub. No.: WO93/00274

PCT Pub. Date: Jan. 7, 1993

[30] Foreign Application Priority Data

Jun. 25, 1991 [DK] Denmark ..... 1235/91

[51] Int. Cl.[6] ..... B65D 1/34

[52] U.S. Cl. ..... 229/123.3; 229/123.2; 229/125.35

[58] Field of Search ..... 229/123.1, 123.2, 123.3, 229/125.35

[56] References Cited

U.S. PATENT DOCUMENTS

| | | | |
|---|---|---|---|
| 3,272,422 | 9/1966 | Miller | 229/125.35 |
| 3,298,593 | 1/1967 | Stephenson | 229/125.35 |
| 3,398,876 | 8/1968 | Ward | 229/125.35 |
| 3,438,483 | 4/1969 | Miller et al. | 229/123.3 |
| 3,454,210 | 7/1969 | Spiegel et al. | 229/125.35 |
| 3,942,676 | 3/1976 | Beckers et al. | 229/125.35 |
| 4,351,473 | 9/1982 | Manizza | 229/125.35 |
| 4,531,668 | 7/1985 | Forbes, Jr. | 229/125.35 |
| 4,955,530 | 9/1990 | Rigby et al. | 229/125.35 |
| 5,002,223 | 3/1991 | Bolte et al. | 229/123.2 |
| 5,253,801 | 10/1993 | Bernstein et al. | 229/123.2 |

*Primary Examiner*—Gary E. Elkins

*Attorney, Agent, or Firm*—Antonelli, Terry, Stout & Kraus

[57] ABSTRACT

A popular type of sales packing for sliced meat comprises a cup shaped lower part having an outstanding edge flange, to which is peelably welded a tight cover sheet as an original closure, while for the reclosing of the cup there is provided a semistiff skirt lid above the cover sheet and in holding engagement with the outer edge of the edge flange. These lids are expensive and unsuitable in more respects, and according to the invention they are avoided in that a self-adhesive label (10) placed on the cover sheet (8) has an edge area located outside a cut line (11) in the sheet, whereby this system will constitute the recloseable part of the packing. As an original closure is used an outer barrier sheet (14), which is removeably secured by peel-seal welding to the edge flange of the lower part or to the top side of the cover sheet (8) as welded to this flange.

4 Claims, 2 Drawing Sheets

RECLOSABLE SALES PACKING, E.G. FOR MEAT SLICES

Figure 1:
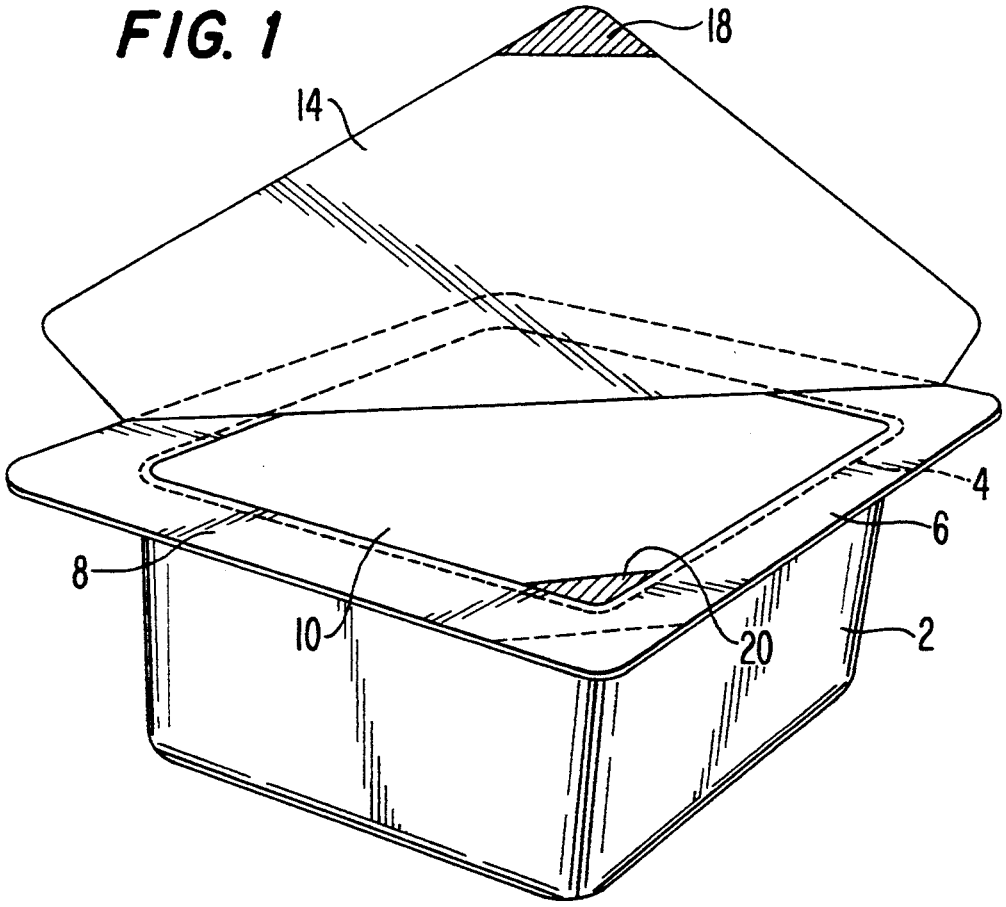

The present invention relates to a packing of the widely known type used as a sales packing for certain foodstuffs, notably small piles of meat slices, and comprising a cup shaped lower part made by die-shaping of a plastic sheet, and upper closing means fastened to a projecting top edge flange of the lower part. Normally, the closing means are formed by a piece of a tight sheet welded to the said edge flange, and an upper reclosing lid, which is also die-shaped from a plastic sheet material, viz. so as to have depending edge portions, which can be releasably held by engagement with the outer edge of the edge flange. Normally, the tight cover sheet carries a paper label, which, in addition to a standard print, may be provided with a price and date marking. The reclosing lid is transparent.

The cover sheet as forming the real barrier closure of the cup part is removable by tearing, normally in being peel welded to the edge flange, and the associated upper lid is usable solely for reclosing the packing once the cover sheet has been entirely or partly torn off in connection with the first opening of the package.

There are some problems connected with these packings, particularly with respect to the reclosing lid. These lids are difficult to mount properly, both at the original closing of the packing and by later, manual reclosings. It is not unusual to find packings without lids in the shop cold counters, just as loose, torn off lids may be found. The lids are produced by thermoshaping of a relatively thick sheet material, and difficulties have been encountered as to the choice of materials that are well suited for use and also suitable as far as treatment of household waste is concerned. Thereby the lids tend to be relatively expensive.

It can be a further drawback that the printed information indicating the kind of the packed product and e.g. its keeping date will normally be removed by the tearing off of the cover sheet.

It is the purpose of the invention to provide a packing of the relevant type which will be usable in an acceptable manner without being having the discussed, particular reclosing lid.

The packing according to the invention is characteristic in being provided with two layers of cover sheets, viz. an inner cover sheet and and outer barrier sheet. The cover sheet is welded to the edge flange of the cup part, while the upper barrier sheet is secured to the same flange by a tight, but peelable welding, preferably in an indirect manner, by welding to the edge area of the cover sheet. The barrier sheet constitutes the long term sealed portion of the packing, and it is simply torn off when the packing is to be used. The label of paper or plastic sheet is still located on the inner cover sheet, but here it will remain in place, because only the barrier sheet is removed. The inner cover sheet is prepared such that shortly inside the inner mouth edge of the cup member it is provided with a cutting or perforation line extending along a suitable partial length of the circumference of the cup mouth, and the paper label is dimensioned and mounted such that it projects beyond this line, the label being removably held by means of a pressure sensitive adhesive.

Thereby it will be the inner sheet that will provide for the desired re-closability. The paper label may have a projecting tag that is not provided with adhesive or is otherwise easily seizable for an initial pulling up of the label; however, as also known from certain prior art packings that are closed in a similar manner, the result will be a pulling up not only of the label, but also of the underlying sheet portion inside the said cutting or perforation line, i.e. the packing will be opened. E.g. by a marking on the label it may be indicated that the pulling up should be effected only to a certain limit, e.g. until about half of the cup mouthing has been uncovered, as this may be sufficient for the removal of goods from the cup part. In return, a face-to-face engagement will be maintained between the label and a stationary part of the cover sheet; this implies that upon the removal of goods from the packing the pulled up label and sheet portion may be returned in a well defined manner. By such a returning or laying down the label edge portions protruding from the cover sheet will be brought into adhering engagement with the cover sheet edge portion which has remained in rigid welding connection with the edge flange of the cup member, preferably slightly protruding inwardly in the upper mouthing of the cup member, and hereby the desired reclosing function is achievable in a very easy and safe manner, because the pulled up area, when being swung down, will be self guiding for assuming a correct reclosing position.

It should be mentioned that the discussed kind of reclosability is known from some special sheet packings containing cleansing napkins. At one side of the packing the sheet is provided with a cut tongue portion which, when swung up, will leave an opening through which the next napkin can be removed. The tongue portion is covered by a self adhering paper or plastic label, which projects beyond the edge of the tongue so as to thereby be usable for a reclosing, by adherence to the packing sheet around the tongue portion. With the invention it has been recognized that this reclosing technique may be used with advantage in the present connection, even though this will imply that preferably the cover sheet should have an edge area projecting slightly inwardly from the upper mouthing edge of the cup member of the packing; thereby it is achieved with increased safety that the openable sheer portion will not at any place be firmly welded to the cup member. In practice this potential drawback with respect to the inwardly protruding edge portion will be without any real significance, and it will condition that in return it will be possible to totally dispense with the far more problematic reclosing lid.

The considered known reclosing technique, which is also known from from U.S. Pat. No. Re. 27,361, will not be directly applicable in connection with the discussed foodstuff packings, but according to the invention it has been recognized that the technique will be usable when applied in connection with an added, outer cover sheet having good barrier properties and being fastened, unbroken, outside the edge of the said label. This outer sheet will safely remain covering the label on the inner sheet until the outer sheet is removed, and correspondingly both the inner sheet and the label will be extra proteced until the packing is opened. The label will remain fixed to the inner sheet, such that it can still identify the contents and the keeping date thereof.

Here the invention has been related to packings of the undercup type, which will normally hold a regular pile of meat slices, but the same principles may well be used also in connection with flat undertray types, where the slices, lying flat in mutually staggered positions, form a flat layer. These packings are not normally provided with reclosing means, but with the use of the invention this will be possible in an easy and cheap manner.

Figure 2:
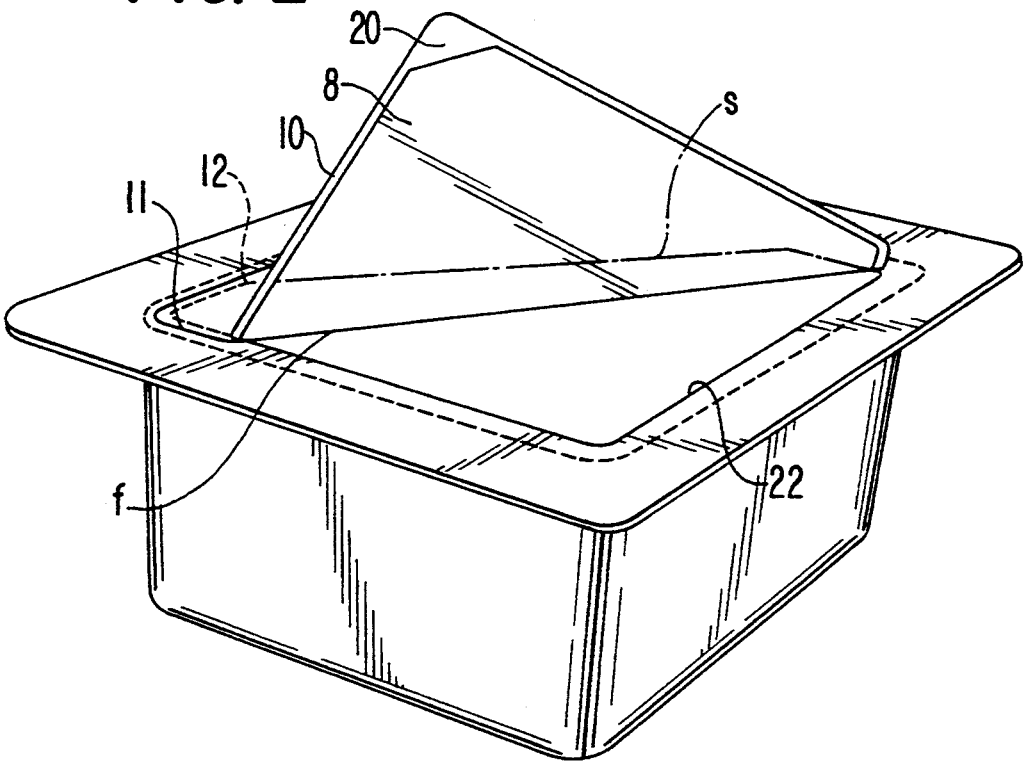
Figure 3:
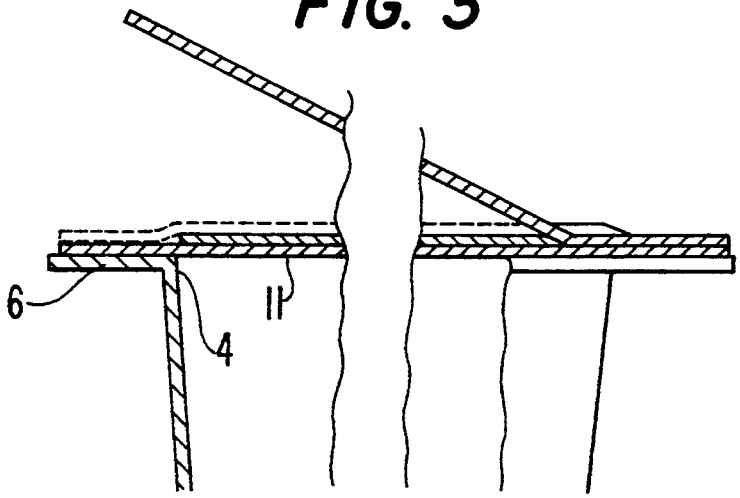
Figure 4:
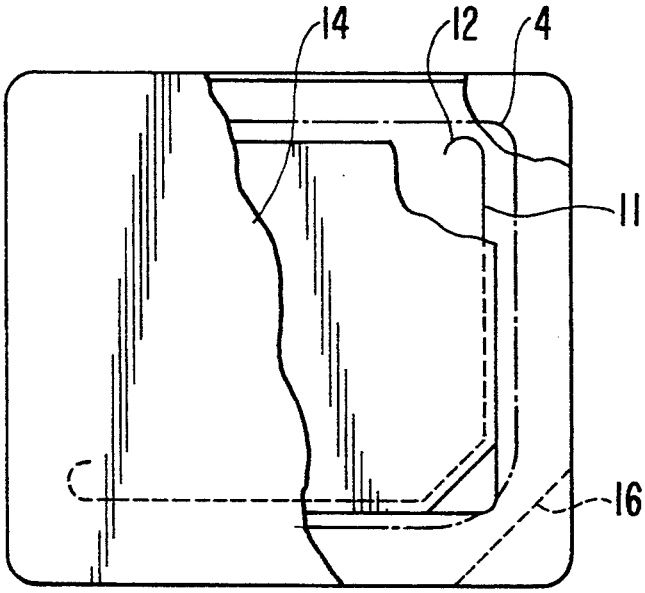

In the following the invention is described in more detail with reference to the drawing, in which FIGS. 1 and 2 are perspective views of a packing according to the invention, FIG. 3 is a sectional view thereof, and FIG. 4 is a further perspective view thereof.

FIGS. 1, 3 and 4 illustrate a packing comprising a lower cup member 2 having an upper mouth edge 4 and an edge flange 6 projecting outwardly therefrom. To the top side of this flange there is firmly welded a cover sheet 8 having on its top side a paper label 10, which is positioned such that preferably all the way round it projects outwardly to or almost out to the mouth edge 4. In this cover sheet there is provided a cutting line 11 extending along two of the mouth sides, still further spaced therefrom; optionally, at a pair of opposed corners of the packing this line may continue along the adjacent sides so as to terminate in welding areas 12. Over these layers 8 and 10 a barrier sheet 14 is laid, secured by peel seal welding to the top side of the cover sheet 8 in an annular area above the edge flange 6. In a manner known per se this welding is not effected in a corner area outside the marked line 16, whereby at this place a gripping flap 18 is provided.

The outer barrier sheet 14 is transparent, such that the paper label 10 is visible through this sheet. When the packing is taken in use the sheet 14 is torn off entirely, as shown in progress in FIG. 1. Thereby the label 10 is uncovered, this label being secured to the underlying sheet 8 by means of a pressure sensitive adhesive and also being provided with a seizable, non-adhering corner flap 20.

When this flap 20 is gripped and lifted the label 10 will be lifted, FIG. 2, whereby also the part of the cover- or undersheet 8 located inside the cutting line 11 will be lifted. As clearly shown in FIG. 2, this part of the sheet will leave an uncovered, self-adhering edge strip area of the slightly protruding label 10, while on the lower part 2 there is correspondingly formed a free mouthing edge 22, which is located shortly inside the edge 4 and obviously follows the cutting line 11.

This lifting of the label 10 with underlying sheet portion 8 can be effected freely until the fold-up line designated f in FIG. 2 proceeds at both ends to the end areas 12 of the cutting line 11, i.e. to the marked dot-and-dash-line s. The lifting may proceed reasonably easily until the line f reaches these areas, whereafter a further lifting will require a real tearing of the sheet 8, this requiring a much higher force. As indicated in FIGS. 2 and 4 it has been found suitable to hereby define a maximum opening corresponding roughly to half the mouthing area of the lower part 2 or just somewhat more, this being sufficient for an easy taking out of slices from the packing.

By a following lying down or folding back of the lifted part of the label 10, the label will automatically be laid back almost exactly in its original position, without this requiring special attention, because the label still adheres to a rather large surface area of the sheet 8 in the remaining, non-lifted area, and with the associated good guiding the label will thus be guided back to the position in which its freely projecting adhering edge portion will close the mouth opening by adherence to the inwardly projecting edge portion of the cover sheet 8 along the edge 22 thereof. Thereby a fully sufficient reclosing of the packing will be achieved, and in the same manner the packing may be opened and reclosed the required number of times.

Optionally, the weldings 12 may be avoided, if the cover sheet 8 is strong enough to resist a tearing-up at the ends of the cutting line. Alternatively it will be possible to make use of bent cutting line ends as shown at 12' in FIG. 4.

In practice it can be a relatively expensive measure to establish the non-adhering flap area 20 on the otherwise adhering label 10, particularly as this partial area is a corner area of a rectangular label. It can be less costly to provide a non-adhering flap which protrudes slightly from a side edge of the label, and there may be space for that if the top sheet 14 is welded to the edge flange 6 only along an outermost edge area thereof.

This problem, however, may also be solved otherwise, viz. by arranging the cutting line 11 to extend closely along the outer contour of the corner area 20. With a finger tip the user may then press this area downwardly and thereby get hold in the corner for a subsequent lifting. Normally, the reclosing in this area will not, then, be fully tight, but the leak will be relatively small, and the users are not in advance used to any tight reclosing, as the said reclosing lids dot not provide for any tight closing.

It is deemed unnecessary to explain in more detail the production of the sheet and label system, as there are no special problems in this. Only it should be mentioned that the cutting line 11 should be interrupted in a few, almost pointlike areas, which are easily broken by the lifting of the label and the associated part of the cover sheet. Hereby the cover sheet can be prepared without problems prior to the following mounting of the label 10.

Optionally the upper barrier sheet 14 may be peelably welded directly to the edge flange 6 of the lower part, if this takes place in an outer area outside the edge of the underlying cover sheet 8, the edge of which should then be welded non-peelably to the remaining inner part of the edge flange. The label 10 need not be of paper, as it may well be a plastics sheet, and in principle it may well be arranged in a manner such that it projects outwardly past the inner mouthing edge 4 of the lower part. The cutting line 11 may extend outside of this mouthing edge, when only the sheet is not welded to the edge flange inside of the cutting line. For reasons of safety, however, it is preferred, as mentioned, that the sheet has an inwardly protruding edge portion, as the positioning accuracy of the sheet 8 should not then be extremely high. The edge of the label 10 should correspondingly extend slightly outside the cutting line, but also slightly inside the mouthing edge, such that it will not happen to reach into the welding area on the edge flange.

As already mentioned the underpart should not necessarily be shaped as a deep cup, as it may as well be shaped as a flat tray.

Preferably the materials in the two sheet layers 8 and 14 selected or prepared such that these sheets may both be welded to the edge flange 6 by a single welding operation, which, in the illustrated embodiment, will result in the sheet 8 being welded to the flange 6, while the outer sheet 14 is concurrently peel welded to the edge portion of the cover sheet 8.

I claim:

1. A sales packing of the type comprising a more or less cup shaped underpart having an outwardly projecting edge flange, to which there is secured, by welding, a cover sheet belonging to a packing closing system for tight original closing and for reclosing, respectively, characterized in that the reclosing system of the packing is of the type comprising a cover sheet having a self adhesive paper or foil label stretching outwardly somewhat beyond a cutting line, which is provided in the sheet so as to extend along at least a substantial part of the length of the upper mouthing edge of the underpart, the cover sheet outside the cutting line being rigidly welded to the edge flange of the underpart, and the tight original closure of the packing being constituted by a barrier forming uppermost sheet, which, by a peelable welding, is removably secured to to the top side of the edge area of the cover sheet or directly to the said edge flange outside of the edge of the cover sheet.

2. A packing according to claim 1, in which the label is adhering all over its lower side, and in which the cutting line at a gripping area extends quite closely to the adjacent edge portion of the label.

3. A packing according to claim 1, in which the cutting line extends along the said mouthing edge, above the mouthing and slightly spaced from that edge, while the label extends in a similar manner, only still less spaced from the mouthing edge.

4. A packing according to claim 1, in which the sheets are of materials allowing them to be welded by one welding operation in a rigid and a peelable manner, respectively.

* * * * *